US005771533A

United States Patent [19]

Kuang-Pin

[11] Patent Number: 5,771,533

[45] Date of Patent: Jun. 30, 1998

[54] DOOR STOPPING DEVICE

[76] Inventor: Wang Kuang-Pin, No.425, Ta-Tun 4th Street, Taichung, Taiwan

[21] Appl. No.: 820,175

[22] Filed: Mar. 19, 1997

[51] Int. Cl.[6] ..... E05F 5/02

[52] U.S. Cl. ..... 16/82; 292/DIG. 15

[58] Field of Search ..... 16/82, 85, 86 R, 16/86 A, 86 B, 86 C, DIG. 21; 292/340, 341.12, DIG. 15, 251.5

[56] References Cited

U.S. PATENT DOCUMENTS

| | | | |
|---|---|---|---|
| 2,519,435 | 8/1950 | Byrd, Jr. | 16/82 |
| 2,798,755 | 7/1957 | Zapotocny | 16/86 A |
| 3,006,676 | 10/1961 | Germock, Jr. | 16/86 A |
| 3,244,443 | 4/1966 | Rodgers | 16/82 |
| 3,328,061 | 6/1967 | Whistler, Sr. | 16/86 A |
| 3,701,557 | 10/1972 | Centofante | 16/86 A |
| 3,831,989 | 8/1974 | Gurzenda | 16/86 A |
| 4,505,502 | 3/1985 | Tomita | 16/82 |
| 4,532,672 | 8/1985 | Anderson | 16/86 A |

*Primary Examiner*—Chuck Mah
*Attorney, Agent, or Firm*—Rosenberg, Klein & Bilker

[57] ABSTRACT

A door stopping device is disclosed. It includes a fitting seat secured on a lower section of the door near the floor and a door stopper. The door stopper includes a base seat formed with a receptacle section for receiving a magnet and a pivot section, a supporting rod having a pivot end and an outer end, a pivot shaft pivotally connecting the pivot end of the supporting rod with the base seat, and a slipproof pad disposed on the outer end of the supporting rod. When the slipproof pad is located at a low position contacting with the floor, the frictional force between the slipproof pad and the floor serves to fully stop the door from moving due to external force. On the contrary, when the outer end of the supporting rod is shifted to a high position above the base seat, the door can be freely closed.

11 Claims, 9 Drawing Sheets

DOOR STOPPING DEVICE

BACKGROUND OF THE INVENTION

The present invention relates to a door stopping device which is able to stop the door from moving due to external force.

FIGS. 1 and 2 show a conventional door stopping device 3 disposed on the bottom of a wall 24. The door 1 serves to isolate a first space 21 from a second space 22 and is mounted on a door frame 11 of a wall 23. When the door 1 is in a totally opened state P1, the door 1 is substantially perpendicular to the wall 23 and parallel to another wall 24. When the door 1 is subject to strong wind, the door 1 is quite apt to be blown to a half-opened state P2 and then quickly shut up into a closed state P3. At this time, a great noise will take place.

Referring to FIG. 2, the stopping device 3 employs a magnetic fixing means to attract the door 1 only when the door 1 is in the totally opened state P1. With respect to the half-opened state P2 or closed state P3, the magnetic fixing means can hardly achieve any fixing effect, not to mention burglarproof effect.

SUMMARY OF THE INVENTION

In order to obviate the above problem, it is a primary object of the present invention to provide a door stopping device which is able to prevent the door from being abruptly opened or closed to cause great noise.

It is a further object of the present invention to provide the above door stopping device which even when the door lock is unlocked unauthorizedly, can still stop the door from being pushed open so as to achieve a burglarproof effect.

The present invention can be best understood through the following description and accompanying drawings, wherein:

DETAILED DESCRIPTION OF THE PREFERRED EMBODIMENTS

Figure 1:
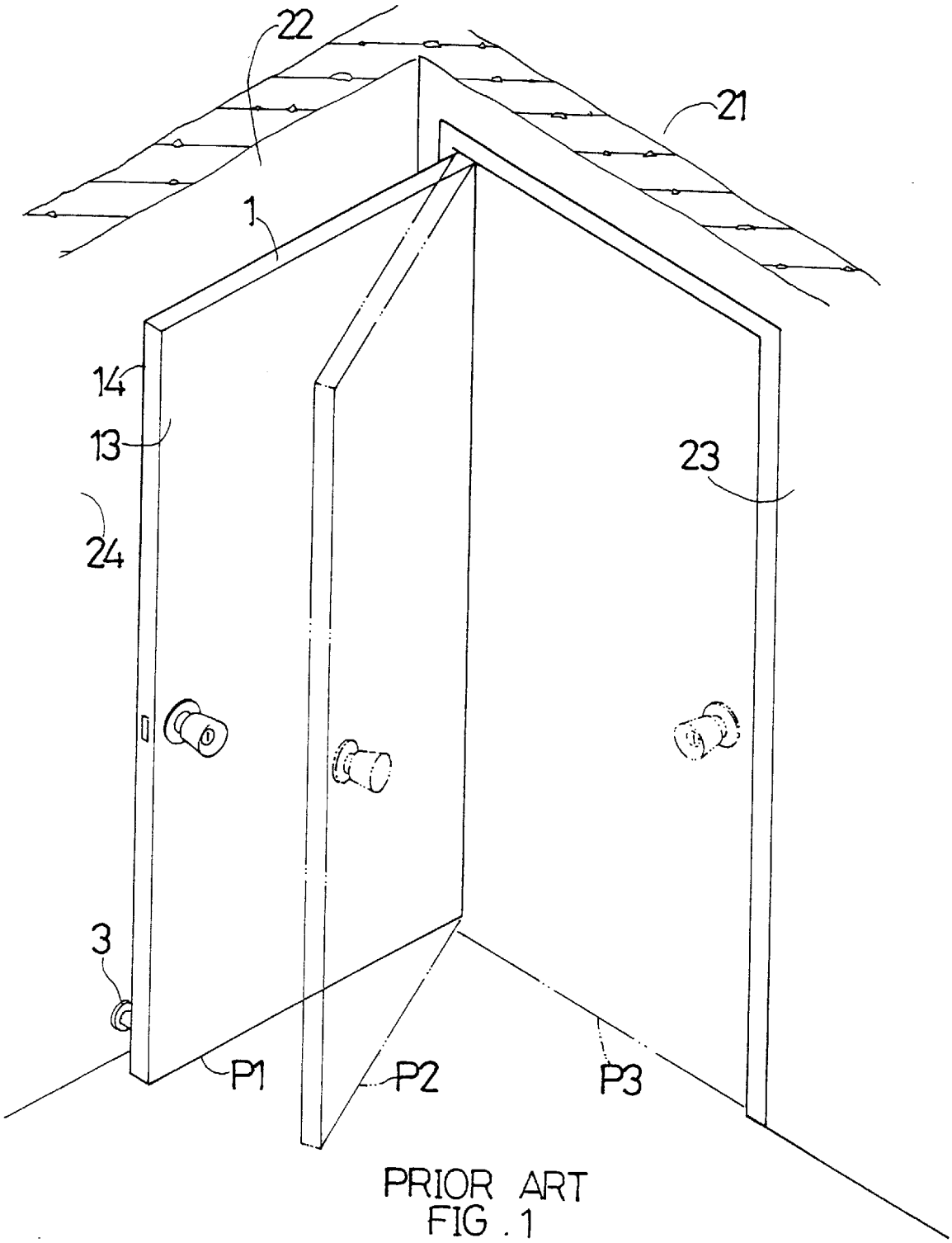
PRIOR ART FIG. 1
FIG. 1 is a perspective view showing the opened and closed states of a door.
Figure 2:
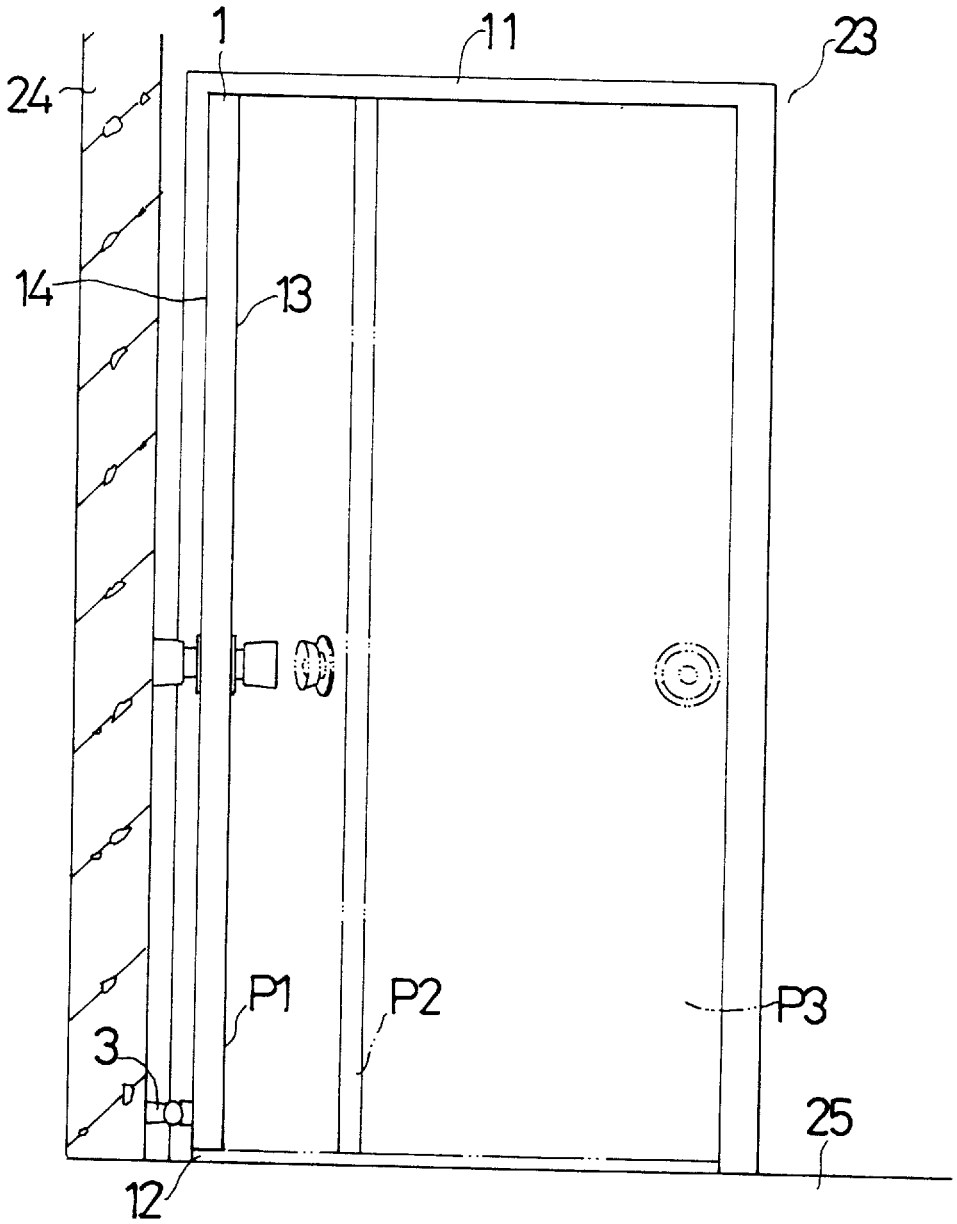
PRIOR ART FIG. 2
FIG. 2 is a front view according to FIG. 1.
Figure 3:
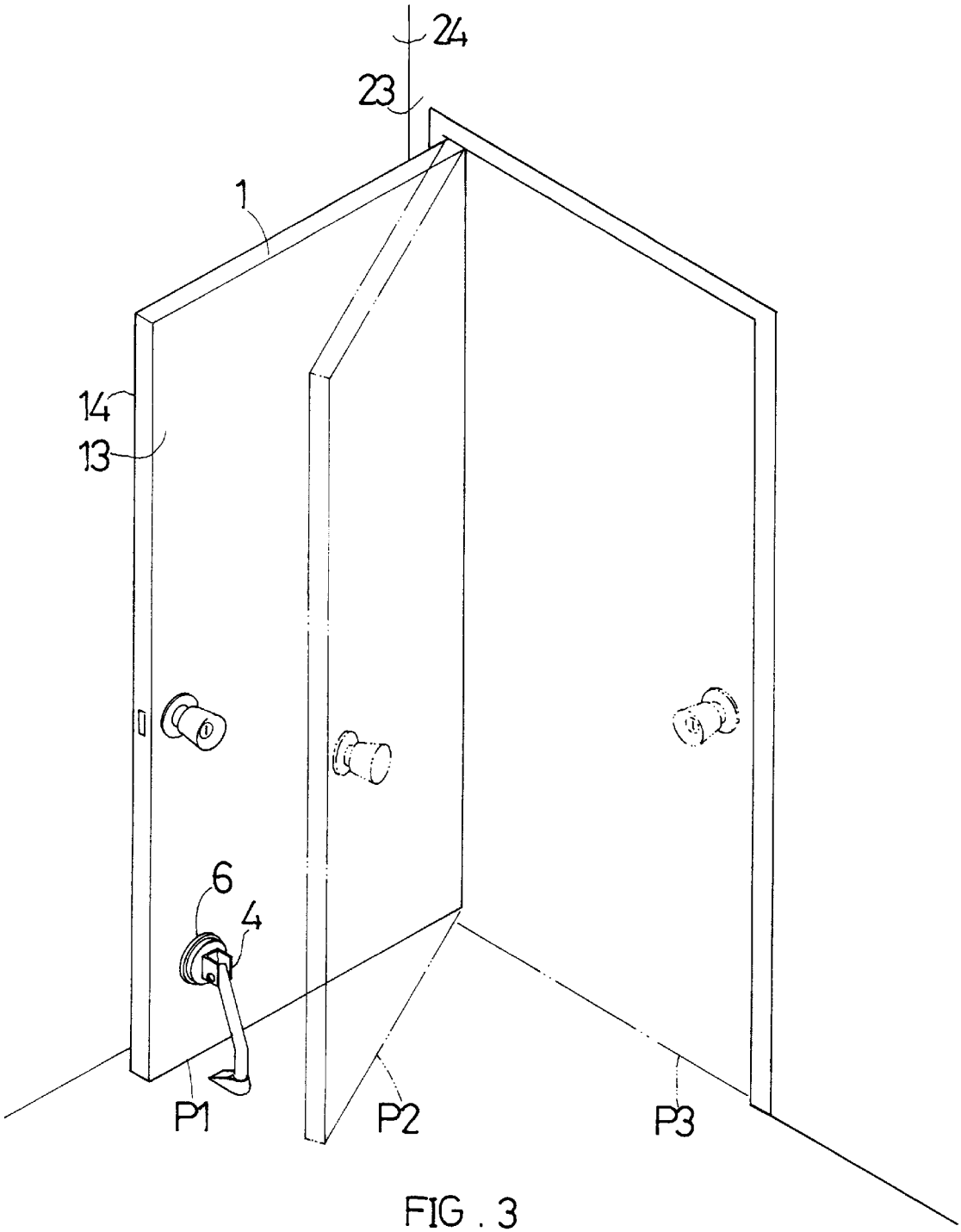
FIG. 3 is a perspective view showing the present invention.

Please refer to FIG. 3. The door stopping device of the present invention includes a fitting seat 6 secured on a lower section of the door 1 near the floor 25 and a door stopper 4.

Figure 4:
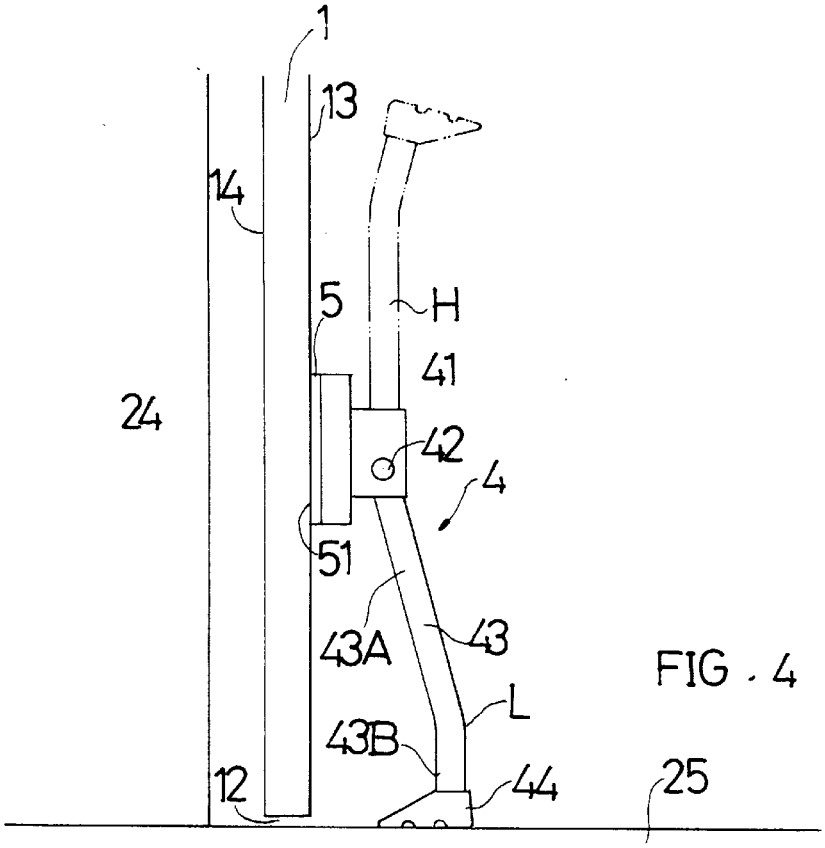
FIG. 4 is a front view of a first aspect of fitting seat of the present invention.
Figure 5:
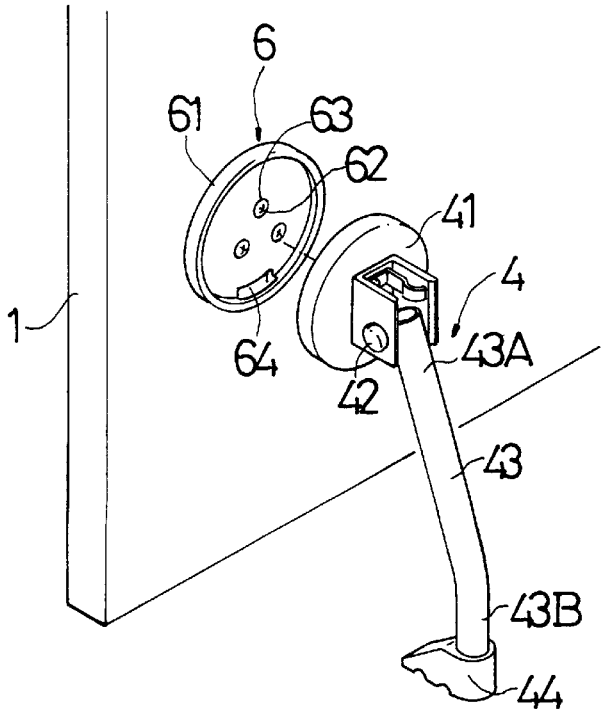
FIG. 5 is a perspective exploded view of a second aspect of fitting seat of the present invention.
Figure 6:
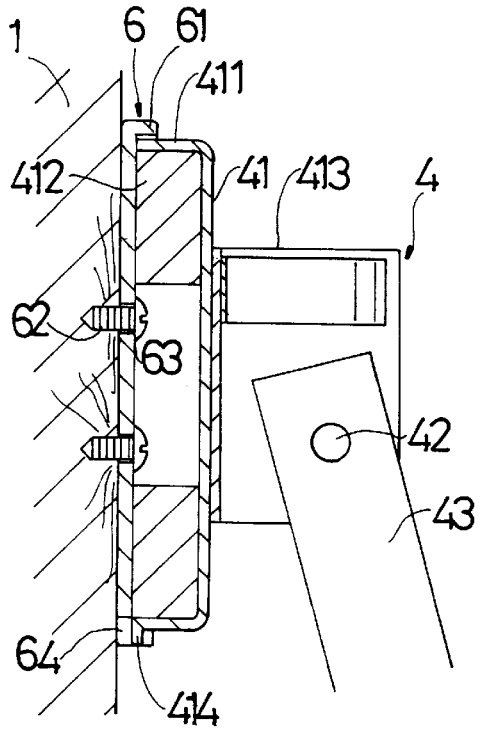
FIG. 6 is a sectional assembled view of the second aspect of fitting seat of the present invention.

Referring to FIGS. 4, 5 and 6, the door stopper 4 includes:

- a base seat 41 formed with a receptacle section 411 for receiving a magnet 412 and a pivot section 413 which is composed of a pair of parallel panels each having a hole;
- a supporting rod 43 having a pivot end 43A and an outer end 43B;
- a pivot shaft 42 pivotally connecting the pivot end 43A of the supporting rod 43 with the base seat 41; and
- a slipproof pad 44 disposed on the outer end of the supporting rod 43 and preferably made of soft rubber or plastic material with greater frictional force on the surface.

According to the above arrangement, when the slipproof pad 44 is located at a low position L contacting with the floor 25, the frictional force between the slipproof pad 44 and the floor 25 serves to stop the door 1 from moving due to strong wind or manually pushing force. On the contrary, when the outer end 43B of the supporting rod 43 is shifted to a high position H above the base seat 41, the door is free from any frictional force.

Referring to FIG. 4, the fitting seat is a circular iron plate 5 one face of which is adhered to the door 1 by a double-side adhesive band 51.

Accordingly, in the case that the door 1 is subject to strong wind, the magnet 412 attracts the iron plate 5 in addition to the frictional force of the slipproof pad 44 so as to fix the door 1 without causing any bothering noise.

Figure 7:
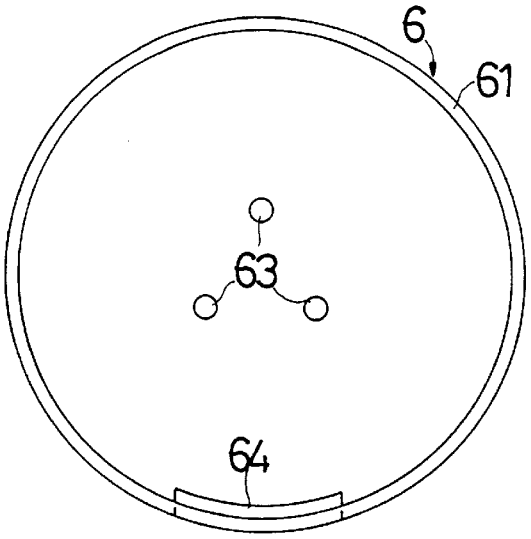
FIG. 7 is a front view of the second aspect of fitting seat of the present invention.

FIGS. 5 to 7 show another aspect of the fitting seat 6 which is formed with a rim 61 for receiving the base seat 41, multiple fixing holes 63 for screws 62 to lock therein and an engaging dent section 64 disposed on the fitting seat 6 near the floor 25. In addition, the bottom end of the base seat 41 is disposed with an engaging projection section 414 for engaging with the engaging dent section 64 as shown in FIG. 7.

The door stopper 4 is tightly engaged with the fitting seat 6 so that the door is prevented from being closed due to a blowing wind. Moreover, when the door 1 is totally closed, a person outside the door cannot push open the door 1 to enter the room.

Figure 8:
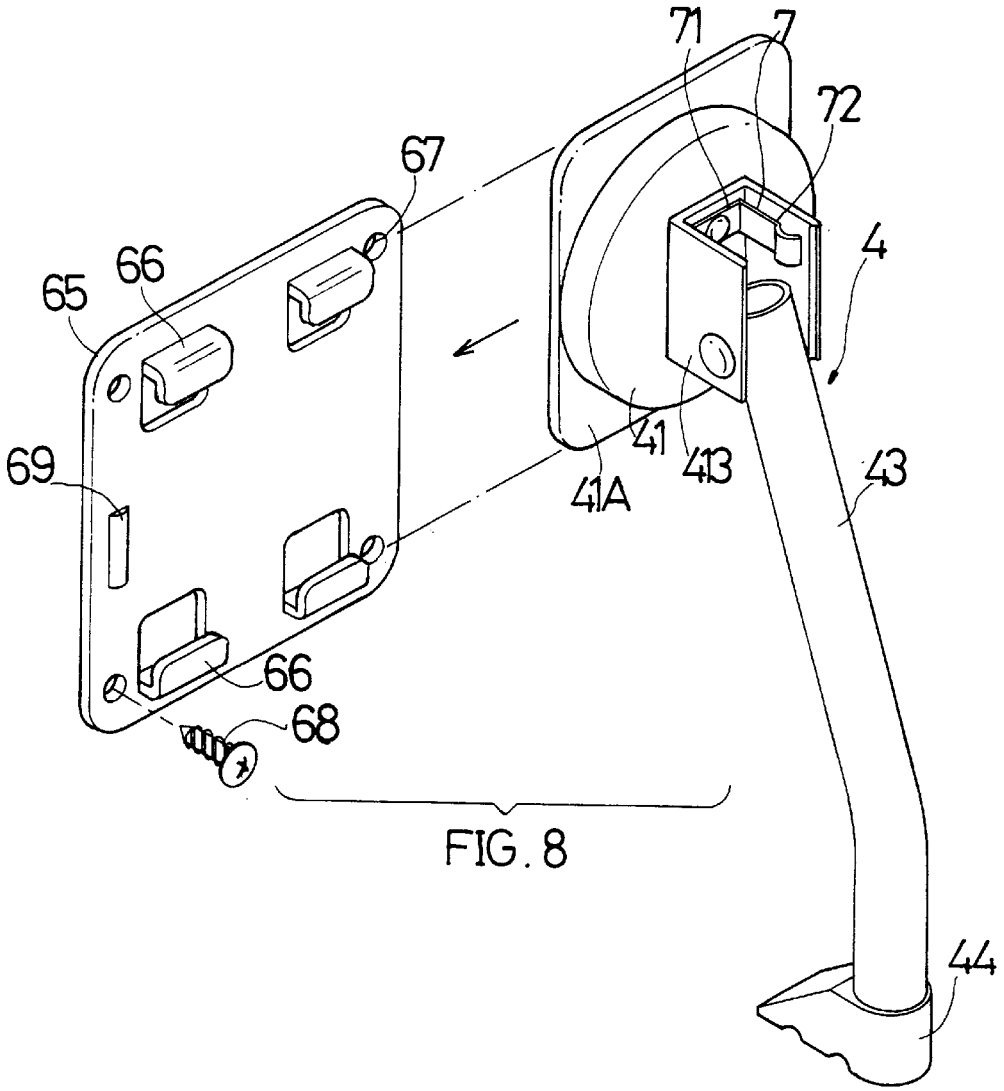
FIG. 8 is a perspective exploded view of a third aspect of fitting seat and a first aspect of fixing structure of the present invention.

FIG. 8 shows still another aspect of the fitting seat 65 which has four latch sections 66 for tightly latching with the fixing plates 41A of the base seat 41, four holes 67, a stopper section 69 for stopping the fixing plate 41A and four screws 68. Accordingly, the base seat 41 can be engaged with the latch sections 66.

Figure 9:
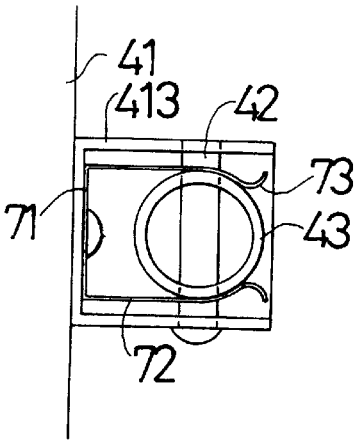
FIG. 9 is a sectional view of the first aspect of fixing structure of the present invention.

In addition, when the supporting rod 43 is located at the high position H, as shown in FIGS. 8 and 9, the supporting rod 43 can be secured by a fixing leaf spring 7 which has a fixing section 71 fixable on the base seat 41 and a pair of resilient plate sections 72. Each resilient plate section 72 has a bent latch section 73 at the end.

Figure 10:
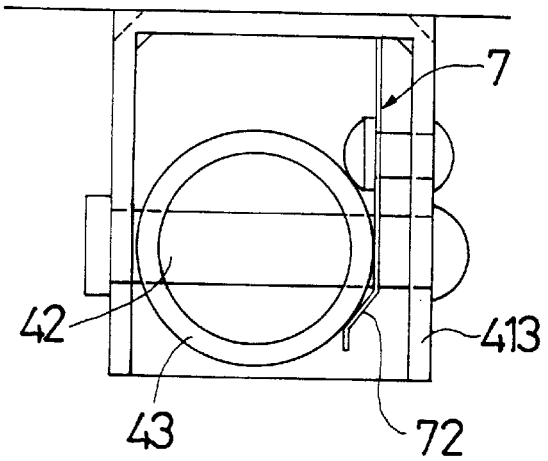
FIG. 10 shows the first aspect of fixing structure employing another fixing leaf spring of the present invention.

As shown in FIG. 10, the fixing leaf spring 7 can alternatively have only one resilient plate section 72 for securing the supporting rod 43.

Figure 11:
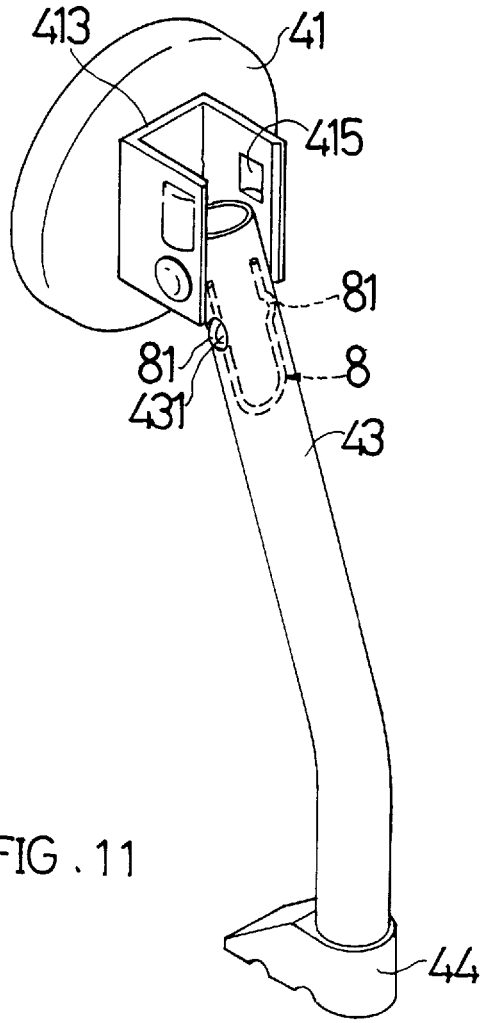
FIG. 11 is a perspective view of a second aspect of fixing structure of the present invention.
Figure 12:
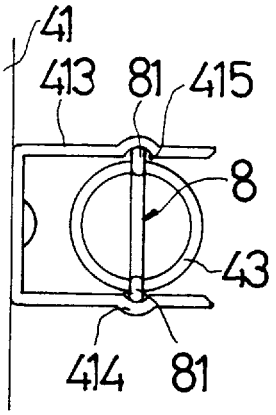
FIG. 12 is a sectional view of the second aspect of fixing structure of the present invention.

FIGS. 11 and 12 show another structure for fixing the supporting rod 43, wherein the pivot section 413 of the base seat 41 is formed with a pair of latch dents 415 and the supporting rod 43 is disposed with a pair of resilient plate holes 431. The interior of the supporting rod 43 is further disposed with a U-shaped inner resilient plate 8 having a projection 81 at each end for passing through the resilient plate hole 431.

Figure 13:
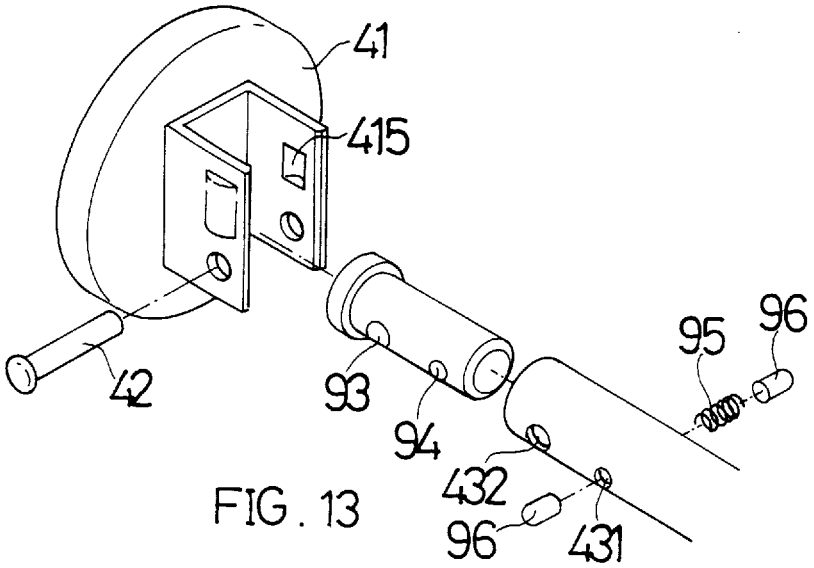
FIG. 13 is a perspective exploded view of a third aspect of fixing structure of the present invention.

FIG. 13 shows still another structure for fixing the supporting rod 43, wherein the pivot section 413 of the base seat 41 is formed with a pair of latch dents 415 and the supporting rod 43 is disposed with a pair of resilient plate holes 431. The interior of the supporting rod 43 is further disposed with a plug block 9 formed with a first and a second through holes 93, 94 for the pivot shaft 42 to insert therein. A spring 95 and a pair of engaging blocks 96 secured to two ends of the spring 95 are fitted in the second through hole 94.

Figure 14:
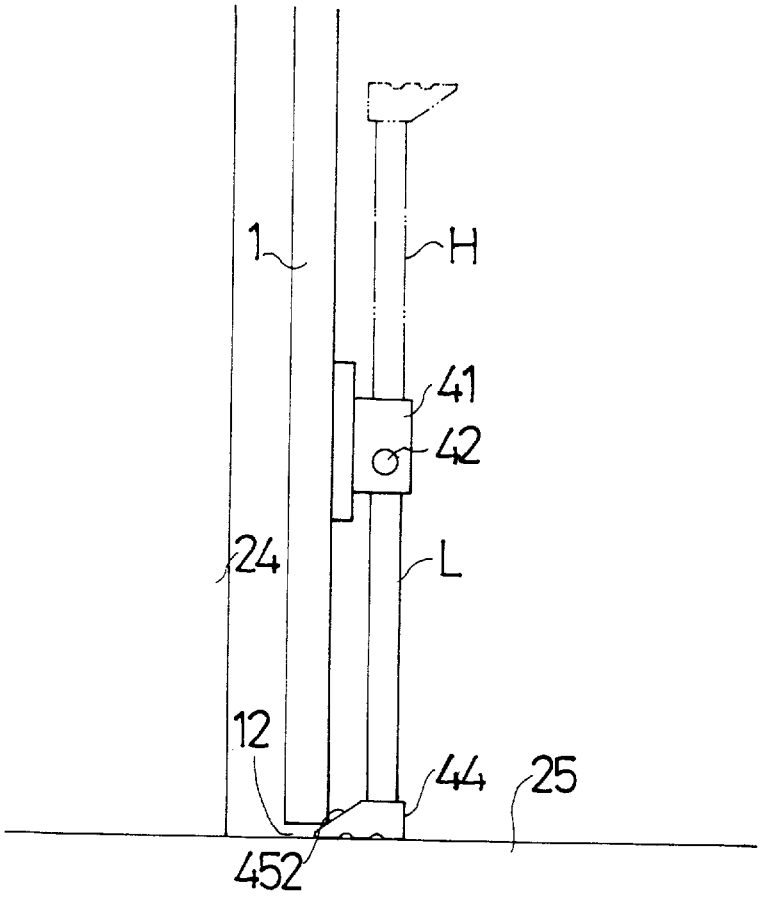
FIG. 14 shows another aspect of slipproof pad of the present invention.

As shown in FIG. 14, the slipproof pad 44 has a slope face 452 for engaging with the bottom end of the door 1 so as to exert greater frictional force onto the floor 25.

In actual use, the present invention is mounted on a first or a second door board 13, 14 of the door 1. Of course, the iron plate 5 can be mounted on the first door board 13 of the door 1. Also, the fitting seat 6 is mounted on the second door board 14, whereby the user himself can move the door stopper 4 to the first or second door board 13, 14.

Figure 15:
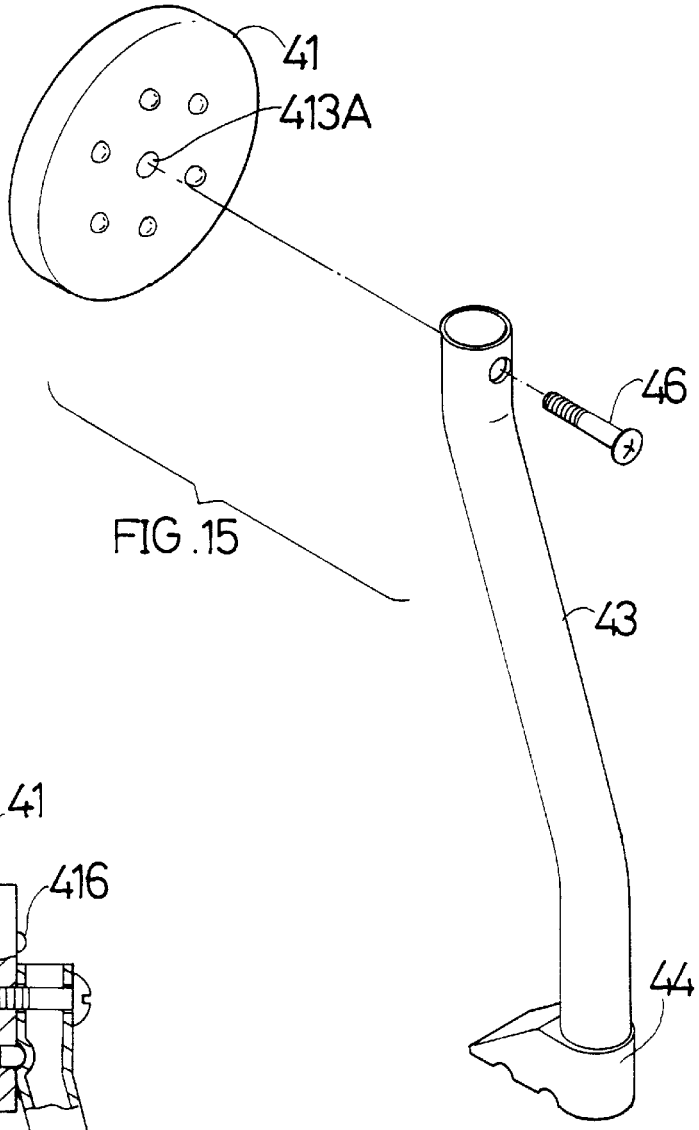
FIG. 15 is a perspective exploded view of a fourth aspect of fixing structure of the present invention.
Figure 16:
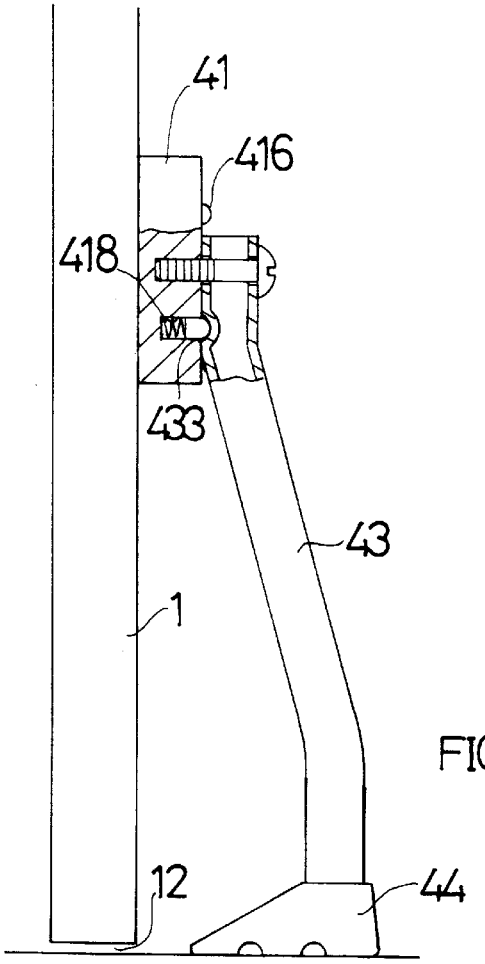
FIG. 16 is a sectional view of the fourth aspect of fixing structure of the present invention.

In addition, FIGS. 15 and 16 show another structure for fixing the supporting rod 43, wherein the supporting rod 43 is disposed with a cavity 433 and the pivot section 413A of the base seat 41 is disposed with annularly arranged projecting blocks 416. One end of the supporting rod 43 is pivotally disposed on the hole-like pivot section 413A of the base seat 41 via a pivot shaft 46. In this example, the supporting rod 43 can be laterally rotated to one side so as to prevent the slipproof pad 44 from contacting with the floor.

It is to be understood that the above description and drawings are only used for illustrating some embodiments of the present invention, not intended to limit the scope thereof. Any variation and derivation from the above description and drawings should be included in the scope of the present invention.

What is claimed is:

1. A door stopping device, comprising:

a fitting seat for securement to a lower section of a door; and a door stopper releasably coupled to said fitting seat, said door stopper including:

a. a base seat releasably coupled to said fitting seat and having a pivot section;

b. a pivot shaft coupled to said pivot section of said base seat;

c. a longitudinally extended supporting rod having opposing first and second ends, said first end being pivotally coupled to said pivot shaft for rotative coupling to said pivot section of said base seat; and, d. a slipproof pad secured to said second end of said supporting rod for frictionally engaging a floor surface when said supporting rod is rotated downwardly, said slipproof pad being disengaged from a floor surface when said supporting rod is rotated upwardly.

2. The door stopping device as recited in claim 1 where said pivot section has a centrally disposed aperture formed through said base seat through which said pivot shaft passes and a plurality of spring biased projecting blocks radially spaced from said aperture and angularly spaced one from another, said supporting rod having a recess formed therein adjacent said first end for detent engagement with a respective one of said plurality of spring biased projecting blocks responsive to rotative displacement of said supporting rod.

3. The door stopping device as recited in claim 1 where said pivot section has a pair of spaced parallel panels, said pivot shaft extending between said pair of parallel panels and said first end of said supporting rod being disposed therebetween.

4. The door stopping device as recited in claim 3 further comprising a fixing leaf spring disposed between said pair of parallel panels, said fixing leaf spring having a fixing section secured to said base seat and at least one resilient plate section, said plate section having a bent latch section adjacent a distal end thereof for releasable engaging said supporting rod.

5. The door stopping device as recited in claim 3 where each of said pair of parallel panels has a latch indentation formed therein, said supporting rod having a longitudinal bore and a pair of opposed through openings formed therein adjacent said first end and in open communication with said bore, said supporting rod having a U-shaped inner resilient plate positioned in said bore, said U-shaped inner resilient plate having a projection formed on each end thereof and extending through a respective one of said pair of opposed through openings for releasable engagement with a respective one of said latch indentations.

6. The door stopping device as recited in claim 1 where said fitting seat is formed by an iron plate having an adhesive band formed on one side thereof for securement to the door.

7. The door stopping device as recited in claim 1 where said fitting seat is formed with a circumferential rim having an indentation formed in a portion thereof, said base seat having a projection extending therefrom for engagement with said fitting seat within said indentation.

8. The door stopping device as recited in claim 1 where said first end of said supporting rod is pivotally coupled to said base seat for rotation laterally with respect thereto, said pivot section of said base seat having a plurality of spring biased projecting blocks angularly spaced one from another and radially spaced from said pivotal coupling of said first end of said supporting rod, said supporting rod having a recess formed therein adjacent said first end for detent engagement with a respective one of said plurality of spring biased projecting blocks to maintain said supporting rod in a predetermined orientation.

9. The door stopping device as recited in claim 1 where said slipproof pad has a sloped upper surface for engaging a bottom edge of the door.

10. A door stopping device, comprising:

a fitting seat for securement to a lower section of a door; and a door stopper releasably coupled to said fitting seat, said door stopper including:

a. a base seat releasably coupled to said fitting seat and having a pivot section, said pivot section having a pair of spaced parallel panels, each of said pair of parallel panels having a latch indentation formed therein;

b. a pivot shaft extending between said pair of parallel panels;

c. a longitudinally extended supporting rod having opposing first and second ends, said first end being pivotally coupled to said pivot section of said base seat, said supporting rod having a bore formed longitudinally therein, a first pair of opposed through openings formed therein adjacent said first end and in open communication with said bore, and a second pair of opposed through openings formed therein spaced from said first pair of openings and in open communication with said bore;

d. a plug block disposed in said bore of said supporting rod and having first and second through holes disposed in respective aligned relationship with said first and second pairs of through openings in said supporting rod, said pivot shaft passing through said first through hole and said first pair of through openings to provide said pivotal coupling of said supporting rod;

e. a spring disposed in said second through hole of said plug block;

f. a pair of engaging blocks respectively disposed on opposing ends of said spring in said second through hole of said plug block, each of said engaging blocks extending through a respective one of said second pair of through openings for releasable engagement with a respective one of said latch indentations; and, g. a slipproof pad secured to said second end of said supporting rod for frictionally engaging a floor surface when said supporting rod is rotated downwardly, said slipproof pad being disengaged from a floor surface when said supporting rod is rotated upwardly.

11. The door stopping device as recited in claim 10 where said slipproof pad has a sloped upper surface for engaging a bottom edge of the door.

* * * * *